US008115372B2

(12) United States Patent
Kameda

(10) Patent No.: US 8,115,372 B2
(45) Date of Patent: Feb. 14, 2012

(54) SPARK PLUG FOR INTERNAL COMBUSTION ENGINE AND METHOD OF MANUFACTURING THE SAME

(75) Inventor: Hiroyuki Kameda, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 555 days.

(21) Appl. No.: 12/183,109

(22) Filed: Jul. 31, 2008

(65) Prior Publication Data

US 2009/0033195 A1 Feb. 5, 2009

(30) Foreign Application Priority Data

Aug. 1, 2007 (JP) ..... 2007-200283
Jun. 20, 2008 (JP) ..... 2008-161565

(51) Int. Cl.
*F02P 13/00* (2006.01)
*H01T 13/04* (2006.01)
*H01T 13/00* (2006.01)

(52) U.S. Cl. ..... 313/143; 313/118; 313/135; 313/141; 313/144

(58) Field of Classification Search ..... None
See application file for complete search history.

(56) References Cited

U.S. PATENT DOCUMENTS 6,831,397 B2 12/2004 Kanno et al.
6,853,116 B2 2/2005 Hori
7,187,110 B2 3/2007 Suzuki et al.
7,199,511 B2 4/2007 Hori
7,291,961 B2 11/2007 Suzuki et al.
7,306,502 B2 12/2007 Hori
7,352,121 B2 4/2008 Ito et al.
7,615,915 B2 * 11/2009 Ito et al. ..... 313/141
7,786,657 B2 * 8/2010 Kato ..... 313/141
7,944,134 B2 * 5/2011 Kyuno et al. ..... 313/141
2005/0093415 A1 5/2005 Suzuki
2006/0276097 A1 12/2006 Suzuki et al.
2007/0277764 A1 12/2007 Ito et al.

FOREIGN PATENT DOCUMENTS

JP 2002-237365 A 8/2002
JP 2005-50732 A 2/2005
JP 2005-123166 A 5/2005
JP 2005-158323 A 6/2005

* cited by examiner

*Primary Examiner* — Natalie Walford
(74) *Attorney, Agent, or Firm* — Sughrue Mion, PLLC

(57) ABSTRACT

A spark plug for an internal combustion engine, includes: a cylindrical insulating body; a center electrode; a cylindrical metal shell; and a ground electrode, as defined herein, wherein the noble metal tip is bonded to the ground electrode via a molten bond, and when viewed in a cross-section including a center axis of the noble metal tip along a longitudinal direction of the ground electrode, a sum of a cross-sectional area of a base-end-side molten bond (A) positioned at a base end side of the ground electrode and a cross-sectional area of a front-end-side molten bond (B) positioned at a front end side of the ground electrode is equal to or greater than 4 $mm^2$, and the cross-sectional area of the front-end-side molten bond (B) is 1.1 to 1.3 times greater than that of the base-end-side molten bond (A).

3 Claims, 10 Drawing Sheets

SPARK PLUG FOR INTERNAL COMBUSTION ENGINE AND METHOD OF MANUFACTURING THE SAME

BACKGROUND OF THE INVENTION

1. Field of the Invention

The present invention relates to a spark plug for an internal combustion engine and a method of manufacturing the same.

2. Description of the Related Art

A spark plug for an internal combustion engine is attached to an internal combustion engine and is used for igniting an air-fuel mixture in a combustion chamber. In general, the spark plug includes an insulating body having an axial hole, a center electrode provided in the axial hole, a metal shell provided on the outer circumference of the insulating body, and a ground electrode which is provided at a front end portion of the metal shell so as to form a spark discharge gap between the center electrode and the ground electrode.

Further, to enhance spark consumption resistance and ignition characteristics, a noble metal tip formed of noble metal alloy such as platinum is bonded to the front end portion of the ground electrode formed of a heat and corrosion resistant metal such as a nickel alloy. When the noble metal tip is bonded to the ground electrode, spot welding by means of a laser beam is performed along the outer peripheral portion of the bonded surface between the ground electrode and the noble metal tip (for example, refer to Japanese Patent No. 3460087).

3. Problems to be Solved by the Invention

Recently, to realize high engine power, there is a tendency to develop high compression ratio engines. In a combustion chamber of such an engine, a noble metal tip or a ground electrode is exposed to high-temperature conditions. In addition, heat is hardly dissipated at the front end side of the ground electrode, and a portion closer to the front end side of the ground electrode is especially subject to high temperatures. Therefore, in the noble metal tip, the ground electrode and the bonded portion therebetween, a difference between heat stress acting on the front end portion of the ground electrode and heat stress acting on the base end portion of the ground electrode may occur. Accordingly, oxidation scales or cracks may develop at the boundary portion between the noble metal tip and the ground electrode, and the noble metal tip may separate from the ground electrode.

Recently, miniaturization of spark plugs has been achieved to accommodate the need for smaller engine size. Further, a metal shell of the spark plug tends to have reduced size and thickness. Therefore, the size of a ground electrode bonded to the metal shell should be reduced, because the bonding area between the metal shell and the ground electrode must be reduced. As a result, the heat dissipation property of the ground electrode is further decreased, and the above-described defects occur more frequently.

SUMMARY OF THE INVENTION

It is therefore an object and advantage of the present invention to provide a spark plug for an internal combustion engine, which can prevent a noble metal tip from separating due to a difference in heat stress, thereby extending its lifespan, and a method of manufacturing the same.

Embodiment 1

The above object has been achieved, in a first aspect of the invention, by providing a spark plug for an internal combustion engine which comprises a cylindrical insulating body having an axial hole extending in an axial direction thereof; a center electrode having a front end surface provided in the axial hole; a cylindrical metal shell provided on an outer circumference of the insulating body; and a ground electrode having a base end provided on a front end portion of the metal shell and a noble metal tip comprising a noble metal having a base end that is bonded to a front end side surface of the ground electrode such that a front end surface of the noble metal tip is opposed to the front end surface of the center electrode. The noble metal tip is bonded to the ground electrode such that a molten bond in which part of the noble metal tip and part of the ground electrode are molten together is formed at an interface between the noble metal tip and the ground electrode. When the molten bond is viewed in cross-section including the center axis of the noble metal tip along the longitudinal direction of the ground electrode, a sum of a cross-sectional area of a base-end-side molten bond A positioned at the base end (proximal) side of the ground electrode and a cross-sectional area of a front-end-side molten bond B positioned at a front end (distal) side of the ground electrode is set to be equal to or greater than 4 $mm^2$, and the cross-sectional area of the front-end-side molten bond B is set to be 1.1 to 1.3 times greater than that of the base-end-side molten bond A.

At least one of the base-end-side molten bond A and the front-end-side molten bond B may be formed so as to cross the center axis of the noble metal tip such that the base-end-side molten bond A and the front-end-side molten bond B overlap each other. In that case, the cross-sectional areas of the base-end-side molten bond A and the front-end-side molten bond B may be determined as follows. That is, two intersection points between an outline forming the outer shape of the base-end-side molten bond A and an outline forming the outer shape of the front-end-side molten bond B on the cross-section including the center axis of the noble metal tip along the longitudinal direction of the ground electrode are connected through a straight line. A molten portion divided at the base-end-side molten bond A is determined as "the base-end-side molten bond A", and a molten portion divided at the front-end-side molten bond B is determined as "the front-end-side molten bond B". Further, the "noble metal material" for forming the noble metal tip includes not only a noble metal such as platinum (Pt) or Iridium (Ir), but also a material composed mostly of noble metal.

According to the above first aspect, since the noble metal tip is bonded to the front end portion of the ground electrode, it is possible to enhance spark consumption resistance and ignition characteristics.

Meanwhile, since heat is hardly dissipated at the front end side of the ground electrode, a larger heat stress tends to occur in a portion of the noble metal tip or the molten bond which is close to the front end portion of the ground electrode. In particular, when the front end side or the base end side is considered in a state where the center of the noble metal tip is set as a base point, a relatively large heat stress occurs in the front end side, but a relatively small heat stress occurs in the base end side. The molten bond, which is formed between the ground electrode and the noble metal tip by welding, absorbs a difference in thermal expansion therebetween, and prevents the noble metal tip from separating from the ground electrode. However, when the front-end-side molten bond and the rear-end-side molten bond have the same area, the heat stress difference is not absorbed, and peeling of the noble metal tip occurs at the boundary portion between the ground electrode and the noble metal tip.

In the above first aspect, when the molten bond is viewed in cross-section including the center axis of the noble metal tip along the longitudinal direction of the ground electrode, the cross-sectional area of the front-end-side molten bond B is set to be 1.1 to 1.3 times greater than that of the base-end-side molten bond A. As a result, it is possible to increase the length of the boundary between the front-end-side molten bond B and the noble metal tip (the contact area between the molten bond at the front end side and the ground electrode) and the length of the boundary between the front-end-side molten bond B and the ground electrode (the contact area between the molten bond at the front end side and the ground electrode). Accordingly, since a larger amount of energy can be absorbed in the molten bond at the front end side, it is possible to reduce a gradient in heat stress that the noble metal tip is subjected to. Therefore, the balance of heat stress can be maintained, and the peeling resistance of the noble metal tip can be enhanced, which makes it possible to extend the lifespan of the spark plug.

In the above first aspect, the sum of the cross-sectional area of the base-end-side molten bond A and the cross-sectional area of the front-end-side molten bond B is set to be equal to or greater than 4.0 $mm^2$. Accordingly, sufficient welding strength can be secured, and the spark plug can reliably exhibit the above-described operational effect.

When the sum of the cross-sectional area of the base-end-side molten bond A and the cross-sectional area of the front-end-side molten bond B is less than 4.0 $mm^2$, the welding strength becomes insufficient, and the spark plug may not exhibit the above-described operational effect. Further, when the cross-sectional area of the front-end-side molten bond B is set to be less than 1.1 times that of the base-end-side molten bond A, heat stress from the front end side of the ground electrode is not sufficiently relaxed, and the spark plug may not sufficiently exhibit the above-described operation effect. Meanwhile, when the cross-sectional area of the front-end-side molten bond B is larger than 1.3 times that of the base-end-side molten bond A, heat stress applied from the front end side of the ground electrode to the noble metal tip may be extremely relaxed. As a result, the heat stress applied from the front end side of the ground electrode to the noble metal tip becomes smaller than heat stress applied from the base end side of the ground electrode to the noble metal tip. As a result, the balance of heat stress may be lost.

Embodiment 2

In a second aspect of the invention, the noble metal tip has a base end buried in the ground electrode. Each of the base-end-side molten bond A and the front-end-side molten bond B is divided into (i) a noble-metal-tip-side molten bond C (corresponding to C1 and C2 in FIG. 3) that is within a noble metal tip side region partitioned by a first rectangular hypothetical outline of the noble metal tip before the molten bond is formed, and (ii) a ground-electrode-side molten bond D (corresponding to D1 and D2 in FIG. 3) that is within a region partitioned by a second hypothetical outline of the ground electrode before the molten bond is formed and outside the region partitioned by the first rectangular hypothetical outline. In at least one of the base-end-side molten bond A and the front-end-side molten bond B, the cross-sectional area of the ground-electrode-side molten bond D (corresponding to D1 (D2) in FIG. 3) is set to be 1.0 to 2.0 times larger than that of the noble-metal-tip-side molten bond C (corresponding to C1 (C2) in FIG. 3) in a cross-section including the center axis of the noble metal tip along the longitudinal direction of the ground electrode.

According to the above second aspect, the cross-sectional area of the ground-electrode-side molten bond D in at least one of the base-end-side molten bond A and the front-end-side molten bond B (corresponding to D1 or D2 in FIG. 3) is set to be 1.0 to 2.0 times larger than that of the noble-metal-tip-side molten bond C (corresponding to C1 or C2 in FIG. 3). Accordingly, the line expansion coefficient of the molten bond approximates the line expansion coefficient of the noble metal material or the metal material. That is, in terms of thermal expansion, the volume change of the molten bond significantly differs from that of the noble metal material. Further, the volume change of the molten bond significantly differs from that of the metal material. As a result, it is possible to prevent an increase in shear force caused by the thermal expansion in the boundary portion between the molten bond and the noble metal tip or between the molten bond and the ground electrode. Accordingly, it is possible to prevent the occurrence of oxidation scales or cracks at the respective boundaries. As a result, it is possible to further enhance peeling resistance.

When the cross-sectional area of the ground-electrode-side molten bond D (corresponding to D1 and D2 in FIG. 3) is set to be less than 1.0 times that of the noble-metal-tip-side molten bond C (corresponding to C1 and C2 in FIG. 3), the coefficient of linear expansion of the molten bond approximates that of the noble metal material. Therefore, a difference in coefficient of linear expansion between the molten bond and the ground electrode further increases. As a result, shear force in the boundary portion between the molten bond and the ground electrode increases in accordance with thermal expansion, and cracks or the like may occur between the molten bond and the ground electrode. Meanwhile, when the cross-sectional area of the ground-electrode-side molten bond D (corresponding to D1 and D2 in FIG. 3) is set to be larger than 2.0 times that of the noble-metal-tip-side molten bond C (corresponding to C1 and C2 in FIG. 3), the coefficient of linear expansion of the molten bond approximates that of the metal material. Therefore, the shear force at the boundary portion between the molten bond and the noble metal tip increases, and thus cracks or the like may occur between the molten bond and the noble metal tip.

Embodiment 3

In a third aspect of the invention, when the shortest distance from the front end of the noble metal tip to the base-end-side molten bond A is set to E (mm) and the shortest distance from the front end of the noble metal tip to the front-end-side molten bond B is set to F (mm) on a cross-section including the center axis of the noble metal tip along the longitudinal direction of the ground electrode, the following expressions (1) and (2) are satisfied.

$$1.05 \leqq E/F \leqq 1.25 \quad (1)$$

$$0.3\ \text{mm} \leqq E \leqq 0.5\ \text{mm} \quad (2).$$

When the noble metal tip is subject to high temperature conditions, oxidation resistance decreases, and thus its wear resistance property is degraded. As described above, since heat is hardly dissipated at the front end side of the ground electrode and a portion closer to the front end side of the ground electrode is subject to elevated temperatures, a portion of the noble metal tip which is positioned at the front end side of the ground electrode is easily heated. Therefore, in terms of discharge, wear of a portion of the noble metal tip positioned at the front end side of the ground electrode more easily progresses than in a portion of the noble metal tip positioned at the base end side of the ground electrode. Accordingly, uneven wear of the noble metal tip may occur. When uneven wear of the noble metal tip occurs, the discharge position is destabilized. Therefore, when a flame kernel is spread upon ignition, a variation may occur, thereby degrading combustion efficiency.

According to the third aspect, when the shortest distance from the front end of the noble metal tip to the base-end-side molten bond A is set to E (mm) and the shortest distance from the front end of the noble metal tip to the front-end-side molten bond B is set to F (mm), the molten bond is formed so as to satisfy the expression $1.05 \leqq E/F \leqq 1.25$. That is, the surface area of a portion of the noble metal tip, which is positioned at the front end side of the ground electrode, is set to be smaller than that of a portion of the noble metal tip, which is positioned at the base end side of the ground electrode. Therefore, it is possible to reduce an amount of heat received by the portion of the noble metal tip, which is easily heated and is positioned at the front end side of the ground electrode, and thus it is possible to reduce a temperature difference between the portion of the noble metal tip positioned at the front end side of the ground electrode and the portion of the noble metal tip positioned at the base end side of the ground electrode. Accordingly, it is possible to effectively prevent uneven wear of the noble metal tip and to stabilize the discharge position, thereby enhancing combustion efficiency.

When the surface area of the portion of the noble metal tip positioned at the front end side of the ground electrode is reduced, the surface area of the portion of the molten bond positioned at the front end side of the ground electrode is increased. Therefore, an amount of heat received in the subject potion of the noble metal tip increases, so that the peeling resistance property or durability may be degraded. However, since the metal material (for example, Ni alloy) forming the ground electrode has a lower thermal conductivity than the noble metal material forming the noble metal tip, the thermal conductivity of the molten bond in which the metal material and the noble metal material forming the ground electrode are molten is smaller than that of the noble metal tip. Accordingly, heat from combustion gas is hardly transmitted to the molten bond. Although the surface area of the molten bond increases, an amount of heat received by the molten bond does not extremely increase, and the degradation of peeling resistance or durability hardly occurs.

When $1.05>E/F$ is satisfied, an amount of heat received by the portion of the noble metal tip positioned at the front end side of the ground electrode cannot be sufficiently reduced, and the spark plug may not sufficiently exhibit the above-described operational effect. Further, when $E/F>1.25$ is satisfied, an amount of heat received by the portion of the noble metal tip positioned at the front end side of the ground electrode is extremely reduced, and wear of the portion of the noble metal tip positioned at the base end side of the ground electrode easily progresses. In addition, when $0.3\ \text{mm}>E$ is satisfied, the molten bond is formed at a relatively close position to the spark discharge gap. Consequently, the discharge between the molten bonds easily occurs, which makes it difficult to stabilize the discharge position. Further, when $E>0.5$ mm is satisfied, the noble metal tip further protrudes from the ground electrode, and an amount of heat received by the noble metal tip increases. Therefore, the balance of temperature difference between the portion of the noble metal tip positioned at the front end side of the ground electrode and the portion of the noble metal tip positioned at the base end side of the ground electrode may be lost. Accordingly, the spark plug may not sufficiently exhibit the desired operational effect.

Embodiment 4

In a fourth aspect, the present invention provides a method of manufacturing a spark plug for an internal combustion engine, the spark plug comprising: a cylindrical insulating body having an axial hole extending in an axial direction thereof; a center electrode having a front end surface provided in the axial hole; a cylindrical metal shell is provided on the outer circumference of the insulating body; and a ground electrode having a base end provided on a front end portion of the metal shell and a noble metal tip comprising a noble metal having a base end that is bonded to a front end side surface of the ground electrode such that the front end surface of the noble metal tip is opposed to the front end surface of the center electrode, wherein the noble metal tip is bonded to the ground electrode such that a molten bond in which a part of the noble metal tip and a part of the ground electrode are molten together is formed at an interface between the noble metal tip and the ground electrode. The method comprises a bonding step in which the molten bond is formed by irradiating a laser beam onto an outer peripheral portion of a preliminarily bonded surface between the ground electrode and the noble metal tip, and the noble metal tip is bonded to the ground electrode. In the bonding step, the laser beam is irradiated such that a melting energy for an irradiated portion positioned at the front end side of the ground electrode is larger than the melting energy for an irradiated portion positioned at the base end side of the ground electrode.

According to the fourth aspect, a portion (front-end-side molten bond B) of the molten bond positioned at the front end side of the ground electrode is set to be larger than a portion (base-end-side molten bond A) of the molten bond positioned at the base end side of the ground electrode. Therefore, it is possible to easily and reliably manufacture a spark plug which exhibits the operational effect of the first aspect of the invention.

Embodiment 5

In a fifth aspect, the present invention provides a method of manufacturing a spark plug for an internal combustion engine according to any one of the first to third aspects, the method comprising a bonding step in which the molten bond is formed by irradiating a laser beam onto the outer peripheral portion of a preliminarily bonded surface between the ground electrode and the noble metal tip, so that the noble metal tip is bonded to the ground electrode. In the bonding step, the laser beam is irradiated such that a melting energy for an irradiated portion positioned at the front end side of the ground electrode is larger than the melting energy for an irradiated portion positioned at the base end side of the ground electrode.

The fifth aspect exhibits the same operational effect as the fourth aspect of the invention.

Embodiment 6

In a sixth aspect of the invention, the laser beam is irradiated in such a manner that the melting energy increases from an irradiated portion positioned at the base end side of the ground electrode to an irradiated portion positioned at the front end side of the ground electrode.

The sixth aspect exhibits the same operational effect as the fourth aspect of the invention. In addition, the molten bond is formed so as to gradually increase from an irradiated portion positioned at the base end side of the ground electrode to an irradiated portion positioned at the front end side of the ground electrode. Accordingly, the balance of heat stress applied to the noble metal tip can be maintained, which makes it possible to further enhance the peeling resistance of the noble metal tip.

Embodiment 7

In a seventh aspect of the invention, in the bonding step, the molten bond is formed, under a condition where the irradiation direction of the laser beam is fixed, by rotating the noble metal tip and the ground electrode with a rotation axis that is tilted from the center axis of the noble metal tip about a base point toward the base end side of the ground electrode, wherein an intersection point between the center axis of the noble metal tip and a plane including one side surface of the ground electrode is set as the base point.

As a method for implementing the above third aspect, the irradiation direction of the laser beam (the position where the laser beam strikes) in the portion positioned at the front end side of the ground electrode and the portion positioned at the base end side may be changed. However, when such method is used, an apparatus for changing the irradiation direction is separately needed, thereby complicating the structure of the device and degrading production efficiency.

Therefore, although the irradiation direction of the laser beam is fixed by rotating the noble metal tip and the ground electrode in a state where the axis formed by tilting the center axis of the noble metal tip is set as the rotation axis, the structure of the third aspect (embodiment) can be implemented. That is, according to the seventh aspect, the structure of the above third aspect can be implemented without particular difficulty. Therefore, the structure of the device can be simplified, and production efficiency can be enhanced.

DESCRIPTION OF REFERENCE NUMERALS

Figure 1:
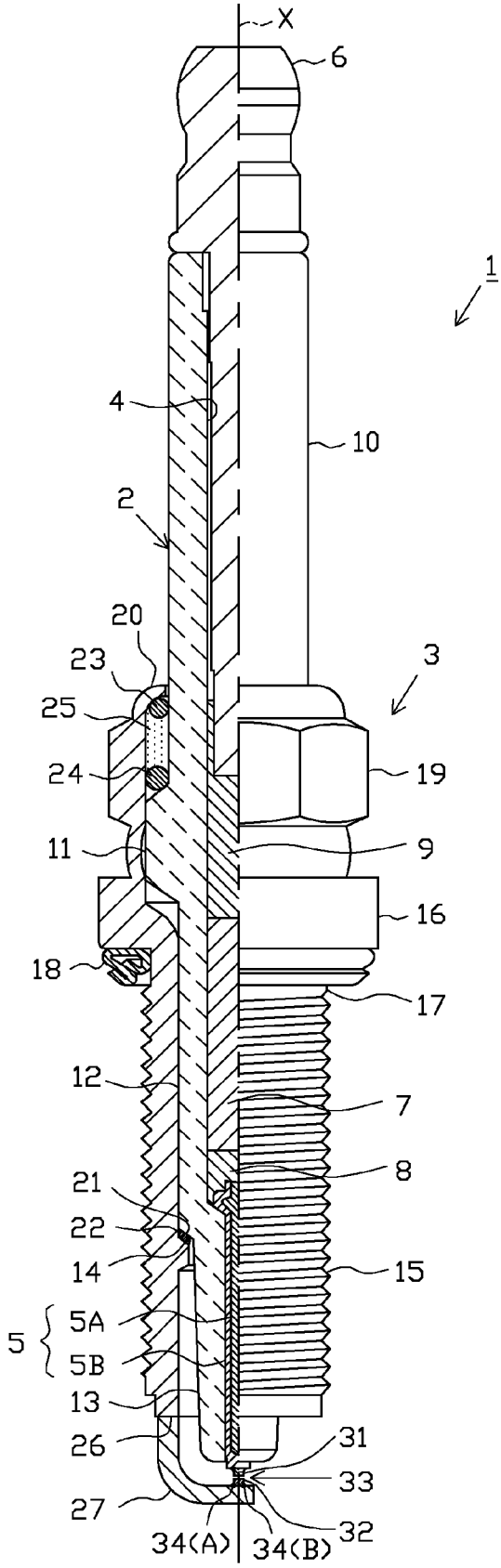
FIG. 1 is a front view of a spark plug according to an embodiment of the present invention, showing a state where the spark plug is partially cut.

Reference numerals used to identify various structural features in the drawings include the following.

1: SPARK PLUG FOR INTERNAL COMBUSTION ENGINE
2: INSULATOR
3: METAL SHELL
4: AXIAL HOLE
5: CENTER ELECTRODE
26: FRONT END PORTION OF METAL SHELL
27: GROUND ELECTRODE
32: NOBLE METAL TIP
33: SPARK DISCHARGE GAP
34: MOLTEN BOND
A: BASE-END-SIDE MOLTEN BOND
B: FRONT-END-SIDE MOLTEN BOND
C1, C2: NOBLE-METAL-TIP-SIDE MOLTEN BOND
D1, D2: GROUND-ELECTRODE-SIDE MOLTEN BOND
N1: FIRST HYPOTHETICAL OUTLINE
N2: SECOND HYPOTHETICAL OUTLINE
X: AXIAL LINE
Y: CENTER AXIS

DETAILED DESCRIPTION OF THE INVENTION

Hereinafter, preferred embodiments of the present invention will be described with reference to the accompanying drawings. However, the present invention should not be construed as being limited thereto. As used herein, as applied to the ground electrode, the term "base end side" refers to a proximal end side (closest to the metal shell), and the term "front end side" refers to distal end side, of the ground electrode.

First Embodiment

FIG. 1 is a front view of a spark plug 1, showing a state where the spark plug 1 is partially cut. In FIG. 1, the direction of an axial line X of the spark plug 1 is set to a vertical direction, the lower side of the spark plug 1 is set to a leading end side, and the upper side of the spark plug 1 is set to a rear end side.

The spark plug 1 includes an insulator 2 as a cylindrical insulating body and a cylindrical metal shell 3 which holds the insulator 2.

The insulator 2 has an axial hole 4 formed along the axial line X, the axial hole 4 penetrating through the insulator 2. Further, a center electrode 5 is inserted and fixed to the leading end side of the axial hole 4, and a terminal electrode 6 is inserted and fixed to the rear end side of the axial hole 4. Between the center electrode 5 and the terminal electrode 6 within the axial hole 4, a resistor body 7 is disposed. Both ends of the resistor body 7 are electrically connected to the center electrode 5 and the terminal electrode 6, respectively, through conductive glass seal layers 8 and 9.

The center electrode 5 and the terminal electrode 6 are fixed in a state where the center electrode 5 protrudes from the leading end of the insulator 2 and the terminal electrode 6 protrudes from the rear end of the insulator 2. Further, a noble metal tip 31 is welded to the leading end portion of the center electrode 5 (described below).

Meanwhile, the insulator 2 is formed by sintering alumina or the like, as is well known to those of ordinary skill in this field of art. The insulator 2 includes a rear end trunk portion 10 formed at the rear end side, a large-diameter portion 11 which is formed at the leading end side from the rear end trunk portion 10 so as to protrude outward in the diameter direction, a middle trunk portion 12 which is formed at the leading end side from the large-diameter portion 11 and has a smaller diameter than the large-diameter portion 11, and a leg length portion 13 which is formed at the leading end from the middle trunk portion 12 and has a smaller diameter than the middle trunk portion 12. The rear end trunk portion 10, the large-diameter portion 11, the middle trunk portion 12, and the leg length portion 13 define the contour of the insulator 2. Among them, the large-diameter portion 11, the middle trunk portion 12, and a great part of the leg length portion 13 are housed in the metal shell 3. Further, a tapered step portion 21 is formed at the connection portion between the leg length portion 13 and the middle trunk portion 12, and the insulator 2 is locked to the metal shell 3 through the step portion 21.

The cylindrical metal shell 3 is formed of metal such as low-carbon steel. On the outer circumference of the metal shell 3, a threaded portion (male threaded portion) 15 for attaching the spark plug 1 to an engine head is formed. The threaded portion 15 has a seat portion 16 formed on the outer circumferential surface thereof at the rear end side, and a ring-shaped gasket 18 is fitted into a thread neck 17 formed at the rear end of the threaded portion 15. Further, the metal shell 3 has a tool engagement portion 19 and a crimping portion 20 provided at the rear end side thereof. The tool engagement portion 19 having a hexagonal cross-section serves to engage a tool such as a wrench when the metal shell 3 is attached to the engine head, and the crimping portion 20 serves to hold the insulator 2 at the rear end portion of the metal shell 3.

The metal shell 3 has a taped step portion 14 provided on the inner circumferential surface thereof such that the insulator 2 is locked to the step portion 21. Further, the insulator 2 is inserted from the rear end side of the metal shell 3, and a step portion 21 of the insulator 2 is locked to the step portion 14 of the metal shell 3. In this state, as a rear-end opening portion of the metal shell 3 is crimped radially inward, the crimping portion 20 is formed to fix the insulator 2. A ring-shaped plate packing 22 is interposed between both of the step portions 14 and 21 of the insulator 2 and the metal shell 3. Accordingly, airtightness within a combustion chamber is maintained to prevent fuel-air mixture that enters the gap between the leg length portion 13 of the insulator 2 and the inner circumferential surface of the metal shell 3 from leaking to the outside.

To more perfectly maintain airtightness by crimping, ring members 23 and 24 are interposed between the metal shell 3 and the insulator 2 at the rear end side of the metal shell 3. Talc powder 25 is filled between the ring members 23 and 24. That is, the metal shell 3 holds the insulator 2 through the plate packing 22, the ring members 23 and 24, and the talc 25.

The metal shell 3 has an L-shaped ground electrode 27 bonded to a leading end portion 26 thereof. That is, the rear end portion of the ground electrode 27 is welded to the leading end portion 26 of the metal shell 3, and the leading end side of the ground electrode 27 is bent such that a side surface of the ground electrode 27 is opposed to the leading end portion (the noble metal tip 31) of the center electrode 5. In this embodiment, the ground electrode 27 is formed of Ni-23Cr-14.4Fe-1.4Al [INCONEL 601 (trademark)], and the thermal conductivity of the metal material is about 0.111 W/cm·K.

A noble metal tip 32 is bonded to the ground electrode 27 so as to be opposed to the noble metal tip 31 (described below). Between the noble metal tips 31 and 32, a spark discharge gap 33 is formed. In this embodiment, the noble metal tip 31 is formed of a well-known noble metal (for example, Pt—Ir alloy), and the noble metal tip 32 is formed of Pt-20Ir-5Rh alloy. Further, the thermal conductivity of the noble metal material is about 0.262 W/cm·K, and is greater than that of the metal material composing the ground electrode 27.

The center electrode 5 includes an inner layer 5A formed of copper or copper alloy and an outer layer 5B formed of nickel (Ni) alloy. The ground electrode 27 is formed of Ni alloy.

The center electrode 5, of which the leading-end-side diameter is reduced, is formed in a rod shape (cylindrical shape) as a whole, and the leading end surface of the center electrode 5 is flattened. The cylindrical noble metal tip 31 is superimposed on the leading end surface of the center electrode 5, and laser welding, electronic beam welding, or resistance welding is performed along the outer peripheral portion of the bonded surface between the noble metal tip 31 and the leading end surface of the center electrode 5 such that the noble metal tip 31 and the center electrode 5 are bonded to each other.

Meanwhile, in a state where the noble metal tip 32 facing the noble metal tip 31 is positioned on a predetermined position of the ground electrode 27 and the based end of the noble metal tip 32 is buried into the ground electrode 27 by resistance welding, the noble metal tip 32 is spot-welded along the outer peripheral portion of the bonded surface by the laser beam. Accordingly, a molten bond 34 in which a noble metal material and Ni alloy are molten is formed, and the ground electrode 27 and the noble metal tip 32 are bonded to each other. Further, the noble metal tip 31 at the center electrode 5 may be omitted. In this case, the spark discharge gap 33 is formed between the noble metal tip 32 and the leading end portion of the center electrode 5.

Figure 2:
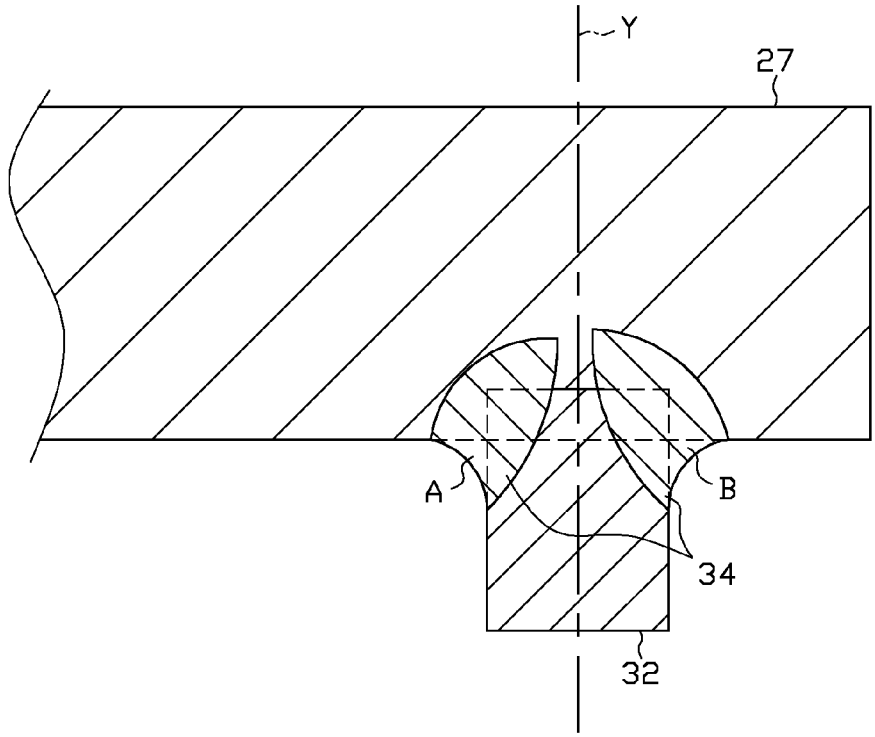
FIG. 2 is a partially-expanded diagram showing the cross-section of a molten bond according to the embodiment of the invention.

In this embodiment, the molten bond 34 is formed such that the volume (molten amount) thereof gradually increases from a base-end-side molten bond A positioned at the base end side (left side of FIG. 1) of the ground electrode 27 to a front-end-side molten bond B positioned at the front end side (right side of FIG. 1) of the ground electrode. More specifically, in a cross section (referred to as a "center axis cross section") including the center axis Y of the noble metal tip 32 along the longitudinal direction of the ground electrode 27, the cross-sectional area of the front-end-side molten bond B is set to be 1.1 to 1.3 times larger than that of the base-end-side molten bond A (for example, 1.2 times), as shown in FIG. 2. In addition, the sum of the cross-sectional area of the base-end-side molten bond A and the cross-sectional area of the front-end-side molten bond B is set to be equal to or more than 4.0 $mm^2$ (for example, 5.0 $mm^2$).

Figure 3:
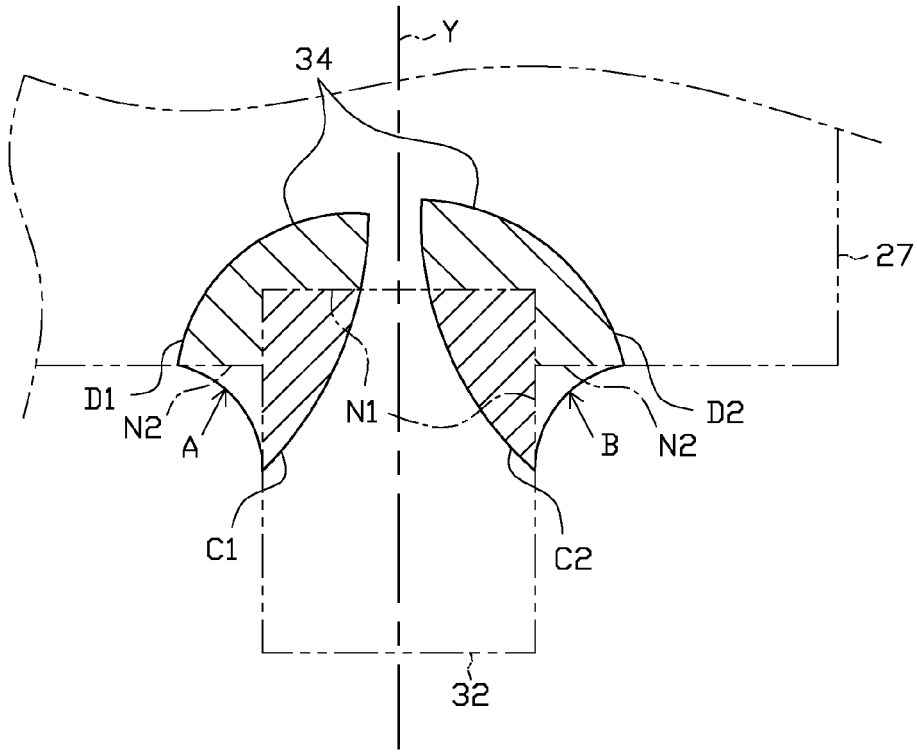
FIG. 3 is a partially expanded schematic view of a noble-metal-tip-side molten bond and a ground-electrode-side molten bond according to the embodiment of the invention.

As shown in FIG. 3, the base-end-side molten bond A and the front-end-side molten bond B are respectively divided into noble-metal-tip-side molten bonds C1 and C2 in a region partitioned by a first rectangular hypothetical outline Ni of the noble metal tip 32 before the molten bond 32 is formed (in a state where the base end of the noble metal tip 32 is buried into the ground electrode 27). Ground-electrode-side molten bonds D1 and D2 are partitioned by a second hypothetical outline N2 of the ground electrode 27 before the molten bond 34 is formed, in a ground-electrode-side region of the region partitioned by the first hypothetical outline N1. Further, the noble-metal-tip-side molten bonds C1 and C2 are indicated by upward sloping lines, and the ground-electrode-side molten bonds D1 and D2 are indicated by downward sloping lines.

In the center axis cross-section, the cross-sectional area of the ground-electrode-side molten bond D1 is set to be 1.0 to 2.0 times larger than that of the noble-metal-tip-side molten bond C1 (for example, 1.5 times), and the cross-sectional area of the ground-electrode-side molten bond D2 is set to be 1.0 to 2.0 times larger than that of the noble-metal-tip-side molten bond C2 (for example, 1.7 times).

Next, a method of manufacturing the spark plug 1 will be described. First, the metal shell 3 is previously processed. That is, a through-hole is formed by cold-forging a cylindrical metal material (for example, a ferrous material such as S17C or S25C or a stainless steel material), thereby manufacturing a rough product. After that, a metal shell intermediate body is obtained by trimming the outer shape of the product by cutting.

Continuously, the ground electrode 27 formed of Ni alloy (for example, INCONEL alloy) is resistance-welded to the front end surface of the metal shell intermediate body. During the welding, a so-called "drip" occurs. After the drip is removed, the threaded portion 15 is formed in a predetermined portion of the metal shell intermediate body by rolling. Accordingly, the metal shell 3 to which the ground electrode 27 is welded is obtained. Further, after the noble metal tip 32 is provided on the ground electrode 27, the ground electrode 27 may be welded to the metal shell intermediate body. On the metal shell 3 to which the ground electrode 27 is welded, zinc plating or nickel plating is performed. Further, a chromate treatment may be performed on the surface of the metal shell 3 so as to enhance corrosion resistance.

The above-described noble metal tip 32 is bonded to the front end portion of the ground electrode 27. More specifically, the base end of the noble metal tip 32 is provisionally locked to a predetermined portion of the ground electrode 27 by resistance welding in a state where the base end of the noble metal tip 32 is buried into the ground electrode 27. Further, while the noble metal tip 32 is relatively rotated about a laser irradiating unit with the center axis Y of the noble metal tip 32 set to a rotational axis, the laser beam is intermittently irradiated onto the outer peripheral portion of the bonded surface between the ground electrode 27 and the noble metal tip 32. More specifically, the laser beam is irradiated a predetermined number of times (for example, 8 times) such that the gaps among the centers of molten points onto which the laser beam is irradiated are substantially equalized. Accordingly, a plurality of molten points (molten bonds 34), which are connected in a ring shape when seen from the front end side of the noble metal tip 32, are formed, and the ground electrode 27 and the noble metal tip 32 are bonded to each other (a spot welding method). Further, during irradiation of the laser beam, the laser beam is irradiated onto the outer peripheral portion of the bonded surface at a predetermined angle, while output energy is increased in a stepwise manner. Specifically, a laser beam having a relatively low energy is irradiated onto a portion of the outer peripheral portion, which is positioned at the base end side of the ground electrode 27, and a laser beam having a relatively high energy is irradiated onto a portion of the outer peripheral portion, which is positioned at the leading end side of the ground electrode 27. Accordingly, the volume of the front-end-side molten bond B formed at the front end side of the ground electrode 27 is larger than that of the base-end-side molten bond A formed at the base end side of the ground electrode 27. Further, as the focal distance of the laser beam is changed without increasing or decreasing the output energy, the respective volumes of the base-end-side molten bond A and the front-end-side molten bond B may be increased or decreased.

To more reliably perform the welding, the plating on a welded portion is removed prior to welding, or a portion thereof is masked when the plating step is performed. Further, the welding of the noble metal tip 32 may be performed after combination which will be described below.

Meanwhile, the insulator 2 is molded separately from the metal shell 3. For example, base stock granulated particles are prepared using an alumina-based raw material powder including binder, and rubber pressing is performed using the base stock granulated particles, thereby obtaining a cylindrical mold. Then, cutting is performed on the mold thus obtained so as to form a shape. Further, the shaped mold is placed into a sintering furnace and then sintered. Various kinds of polishing are performed after the sintering to obtain the insulator 2.

Further, the center electrode 5 is manufactured separately from the metal shell 3 and the insulator 2. That is, Ni alloy is forged so as to provide an inner layer 5A on the central portion of the center electrode 5. The inner layer 5A is formed of a copper alloy so as to enhance a heat radiation property. Further, the above-described noble metal tip 31 is bonded to the front end portion of the center electrode 5 by resistance welding or laser welding.

The insulator 2, the center electrode 5, the resistor body 7 and the terminal electrode 6 are sealed and fixed by the glass seal layers 8 and 9. In general, the glass seal layers 8 and 9 are prepared by mixing borosilicate glass and metal powder. The prepared mixture is injected into the axial hole 4 of the insulator 2 so as to interpose the resistor body 7, and is then fused in a sintering furnace in a state where the terminal electrode 6 is pressed from the rear side. At this time, a glaze layer may be simultaneously sintered on the surface of the rear-end-side trunk portion 10 of the insulator 2, or may be previously formed.

After that, the insulator 2 having the center electrode 5 and the terminal electrode 6 manufactured in such a manner is assembled into the metal shell 3 having the ground electrode 27. More specifically, as a rear-end-side opening of the metal shell 3 with a relatively thin wall is crimped radially inward, the crimping portion 20 is formed to the fix the insulator 2 and the metal shell 3.

Finally, as the ground electrode 27 is bent, processing for adjusting the spark discharge gap 33 between the noble metal tip 31 provided at the front end portion of the center electrode 5 and the noble metal tip 32 provided on the ground electrode 27 is performed.

Through the above-described series of steps, the spark plug 1 having the above-described construction is manufactured.

To confirm an operational effect exhibited by this embodiment, the following test was performed. That is, spark plug samples were manufactured by bonding the noble metal tip to the ground electrode and changing the sum (SA+SB) of the cross-sectional area (SA) of the base-end-side molten bond and the cross-sectional area (SB) of the front-end-side molten bond, a cross-sectional area ratio of SB to SA (SB/SA), and a cross-sectional area ratio (SD/SC) of the cross-sectional area (SD) of the ground-electrode-side molten bond at the front end side of the ground electrode to the cross-sectional area (SC) of the noble-metal-tip-side molten bond at the front end side of the ground electrode, when the molten bond is viewed in the cross section passing through the center axis of the noble metal tip along the longitudinal direction of the ground electrode. A peeling resistance evaluation test was performed on the respective samples. The results of the test are shown in the polygonal line graphs and contour line graphs of FIGS. 4 to 9. The peeling resistance evaluation test is summarized as follows. That is, the respective spark plug samples were attached to a 2000 cc in-line six-cylinder engine, and the number of cycles was measured until peeling of the noble metal tip occurred. In this test, one cycle is where the engine is maintained in a full-load state (the number of engine rotations=5000 rpm) for one minute and is then maintained in an idling state for one minute. In this test, it is judged that when the number of tip peeling cycles is equal to or more than 10000, the spark plug sample has sufficient peeling resistance.

Figure 4:
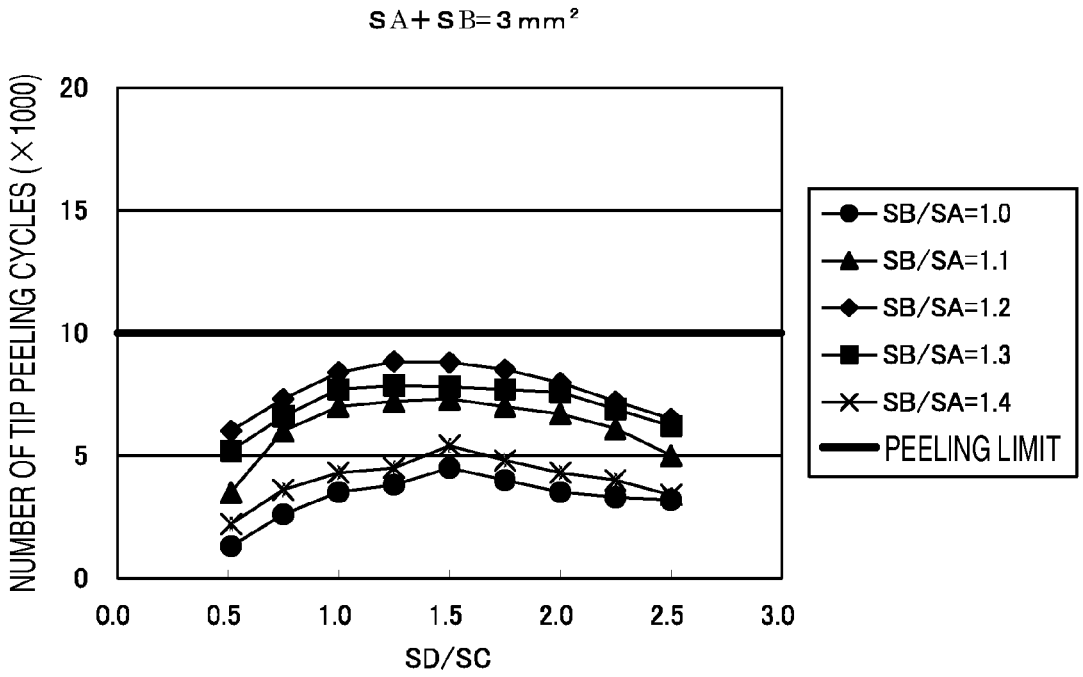
FIG. 4 is a polygonal line graph showing the result of a peeling resistance evaluation test when the sum of the cross-sectional area of the noble-metal-tip-side molten bond and the cross-sectional area of the ground-electrode-side molten bond is 3 $mm^2$.
Figure 5:
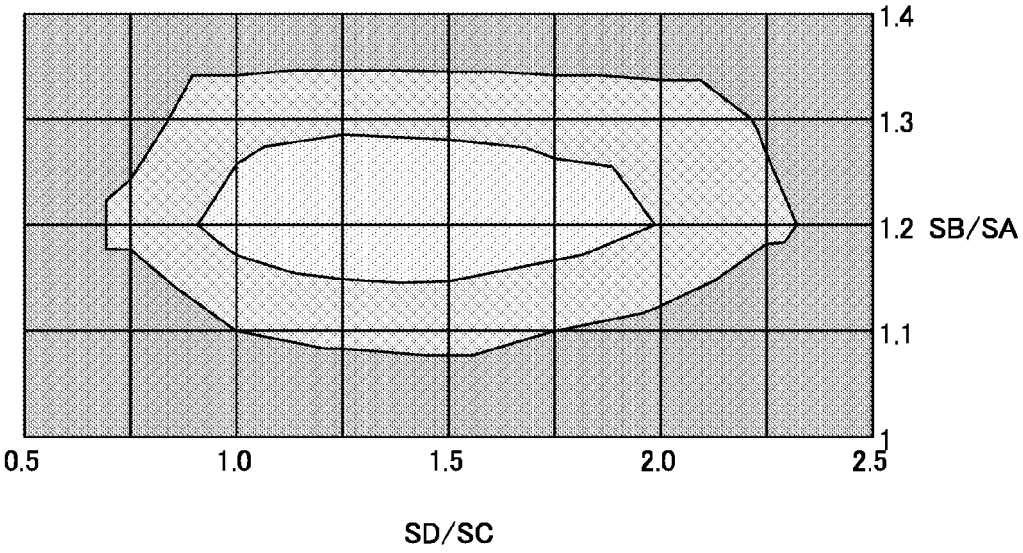
FIG. 5 is a contour line graph showing the result of the peeling resistance evaluation test when the sum of the cross-sectional area of the noble-metal-tip-side molten bond and the cross-sectional area of the ground-electrode-side molten bond is 3 $mm^2$.
Figure 6:
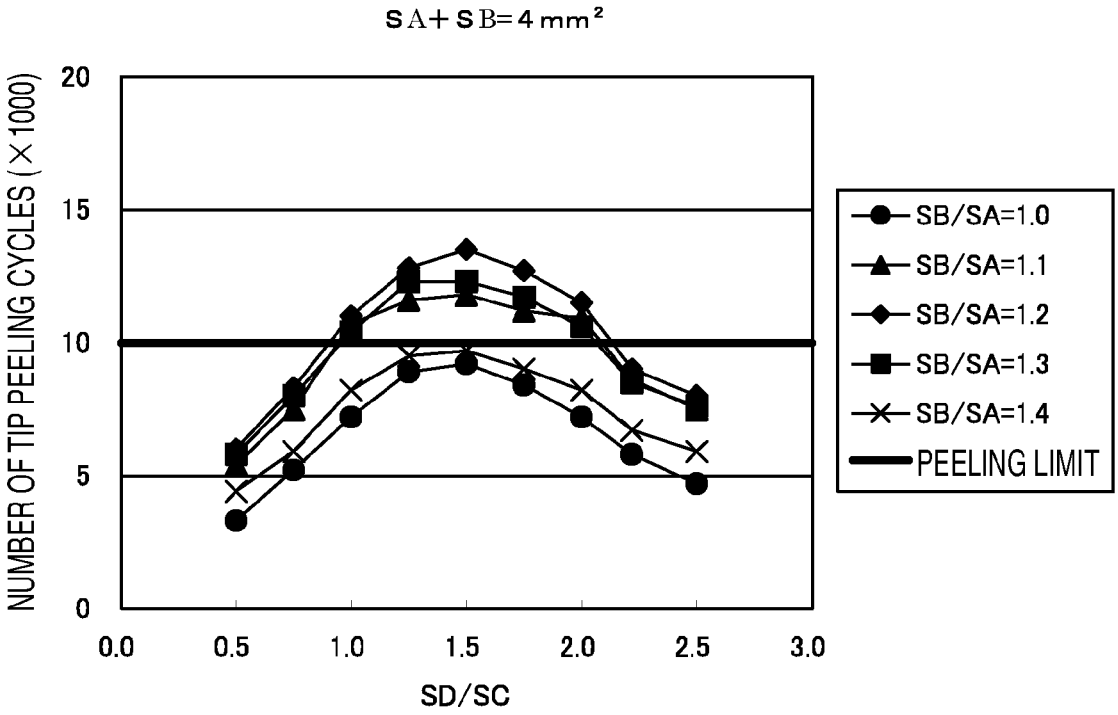
FIG. 6 is a polygonal line graph showing the result of the peeling resistance evaluation test when the sum of the cross-sectional area of the noble-metal-tip-side molten bond and the cross-sectional area of the ground-electrode-side molten bond is 4 $mm^2$.
Figure 7:
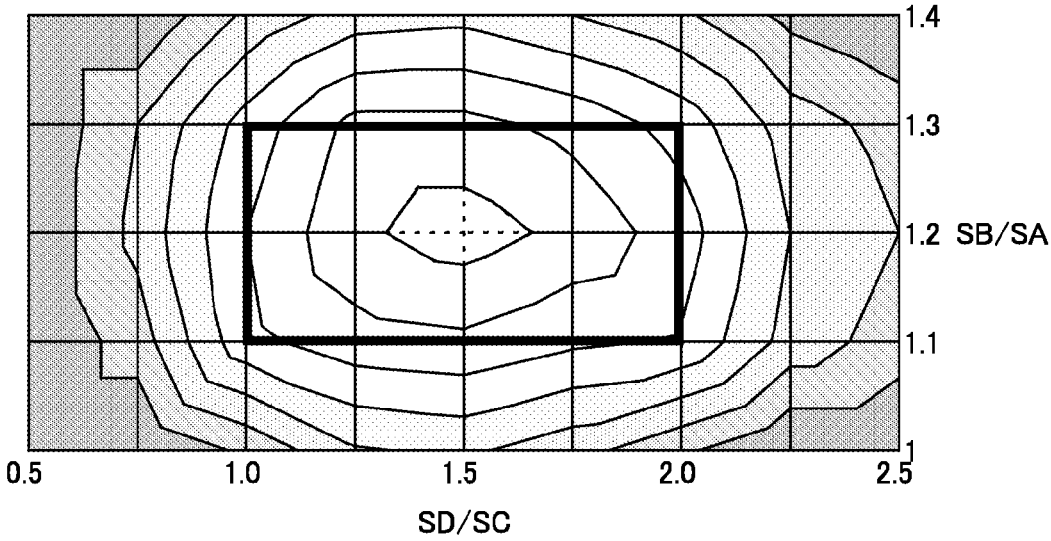
FIG. 7 is a contour line graph showing the result of the peeling resistance evaluation test when the sum of the cross-sectional area of the noble-metal-tip-side molten bond and the cross-sectional area of the ground-electrode-side molten bond is 4 $mm^2$.
Figure 8:
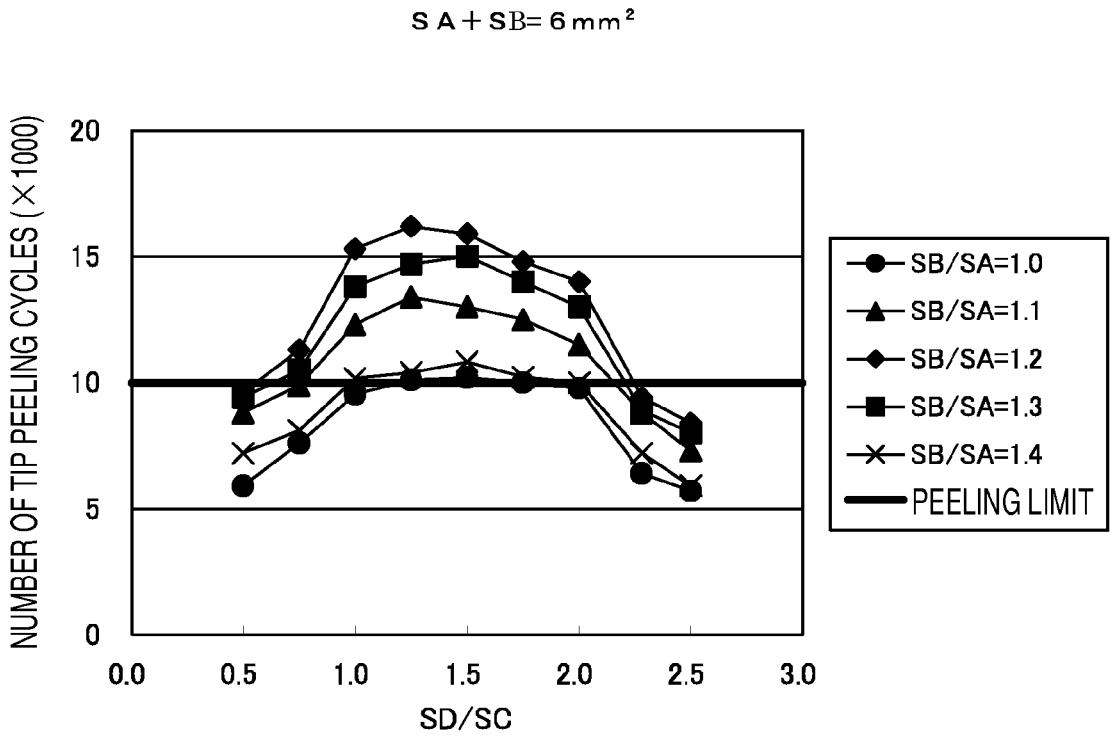
FIG. 8 is a polygonal line graph showing the result of the peeling resistance evaluation test when the sum of the cross-sectional area of the noble-metal-tip-side molten bond and the cross-sectional area of the ground-electrode-side molten bond is 6 $mm^2$.
Figure 9:
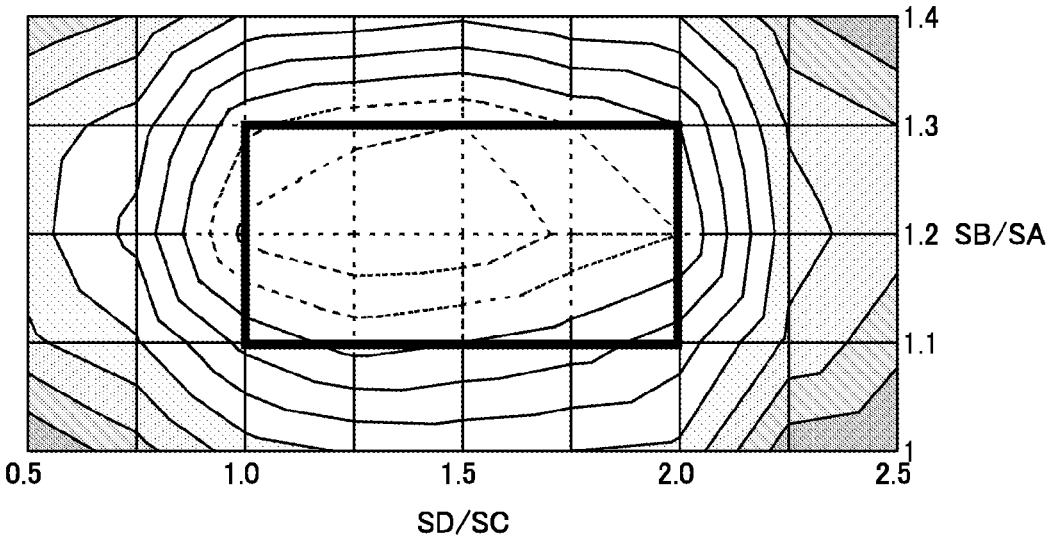
FIG. 9 is a contour line graph showing the result of the peeling resistance evaluation test when the sum of the cross-sectional area of the noble-metal-tip-side molten bond and the cross-sectional area of the ground-electrode-side molten bond is 6 $mm^2$.

FIGS. 4 and 5 are a polygonal line graph and a contour line graph, respectively, with SA+SB set to 3 $mm^2$. FIGS. 6 and 7 are a polygonal line graph and a contour line graph, respectively, with SA+SB set to 4 $mm^2$. FIGS. 8 and 9 are a polygonal line graph and a contour line graph, respectively, with SA+SB set to 6 $mm^2$.

In the respective polygonal line graphs (FIGS. 4, 6 and 8), the vertical axis is set to the number of tip peeling cycles, and the horizontal axis is set to the ratio SD/SC. Further, a sample having a ratio SB/SA of 1.0 is plotted by black circles, a sample of having a ratio SB/SA of 1.1 is plotted by black triangles, a sample having a ratio SB/SA of 1.2 is plotted by black rhomboids, a sample having a ratio SB/SA of 1.3 is plotted by black squares, and a sample of having a ratio SB/SA is 1.4 is plotted by X marks. In addition, a limit value (peeling limit) of 10000 cycles, which can be evaluated as a value where the sample has sufficient peeling resistance, is indicated by a heavy line.

In the respective contour line graphs (FIGS. 5, 7 and 9), the vertical axis is set to the ratio SB/SA, and the horizontal axis is set to the ratio SD/SC. Further, a region where the number of tip peeling cycles is equal to or more than 10000 is indicated by an outline. When the number of tip peeling cycles is equal to or more than 13000, the sample is judged to have extremely excellent peeling resistance. Therefore, cross lines within the region are represented by a dotted line. On the other hand, when the number of tip peeling cycles is less than 10000, the sample is judged as not having sufficient peeling resistance, and the region is represented by scattered dots. In this case, a higher density of dots (higher dot concentration)t shows that the peeling resistance is not sufficient.

FIGS. 4 to 9 show that when the ratio SB/SA is set in a range of from 1.1 to 1.3 regardless of the value of SA+SB, the number of tip peeling cycles increases in comparison with when SB/SA is set to 1.0 or 1.4. This is because, since the area of the boundary between the front-end-side molten bond and the noble metal tip and the area of the boundary between the front-end-side molten bond and the ground electrode increases, heat stress applied to the noble metal tip from a portion of the molten bond or the ground electrode, which is positioned at the front end side of the ground electrode, is relaxed. Thus, good balance between heat stress from the front end side of the ground electrode and heat stress from the base end side of the ground electrode is secured.

Further, as the ratio SD/SC is set in a range of from 1.0 to 2.0, the number of tip peeling cycles was found to further increase. This is because, since the line expansion coefficient of the molten bond is not too close to only the line expansion coefficient of a noble metal material or a metal material, the shear force on the boundary portion between the molten bond and the noble metal tip or between the molten bond and the ground electrode can be prevented from increasing. Thus, it is possible to prevent oxidation scales or cracks from occurring at the respective boundaries.

Meanwhile, as shown in FIGS. 4 and 5, when SA+SB is set to 3 $mm^2$, it was found that the peeling resistance was enhanced by setting the ratio SB/SA to within a range of 1.1 to 1.3 or by setting the ratio SD/SC to 1.0 to within a range of 2.0. However, the sample was not judged to exhibit sufficient peeling resistance. This is because the volume of the molten bond is so small that the welding strength is not sufficient.

On the other hand, as shown in FIGS. 6 and 7, when SA+SB is set to 4 $mm^2$, it was confirmed that as the ratio SB/SA was set to within a range of 1.1 to 1.3 and the ratio SD/SC was set to within a range of 1.0 to 2.0 (the region surrounded by a heavy line in FIG. 7), the number of tip peeling cycles exceeded 10000, and sufficient peeling resistance can be realized.

As shown in FIGS. 8 and 9, when SA+SB is set to 6 $mm^2$, it was confirmed that in a region where the ratio SB/SA is within a range of 1.1 to 1.3 and the ratio SD/SC is within a range of 1.0 to 2.0 (which is surrounded by a heavy line in FIG. 9), a portion where the number of tip peeling cycles exceeded 13000 occupies a great part of the region such that extremely excellent peeling resistance can be realized.

As SA+SB is set to more than 4 $mm^2$, the ratio SB/SA is set to within a range of 1.1 to 1.3, and SD/SC is set to within a range of 1.0 to 2.0, it is possible to sufficiently enhance the peeling resistance of the noble metal tip.

Second Embodiment

Next, a second embodiment of the invention will be described with reference to FIGS. 11 to 16. In this embodiment, the construction of the molten bond 34 and a welding method of the ground electrode 27 and the noble metal tip 32 are different from those of the first embodiment. Therefore, the following descriptions will focus on these differences. Similar to the first embodiment, the center-axis cross-section is formed such that the cross-sectional area of the front-end-side molten bond B is 1.1 to 1.3 times larger than that of the base-end-side molten bond A, and the sum of the cross-sectional area of the base-end-side molten bond A and the cross-sectional area of the front-end-side molten bond B is set to be equal to or more than 4.0 $mm^2$. Further, the cross-sectional areas of the ground-electrode-side molten bonds D1 and D2 are set to be 1.0 to 2.0 times larger than those of the noble-metal-tip-side molten bonds C1 and C2.

Figure 11:
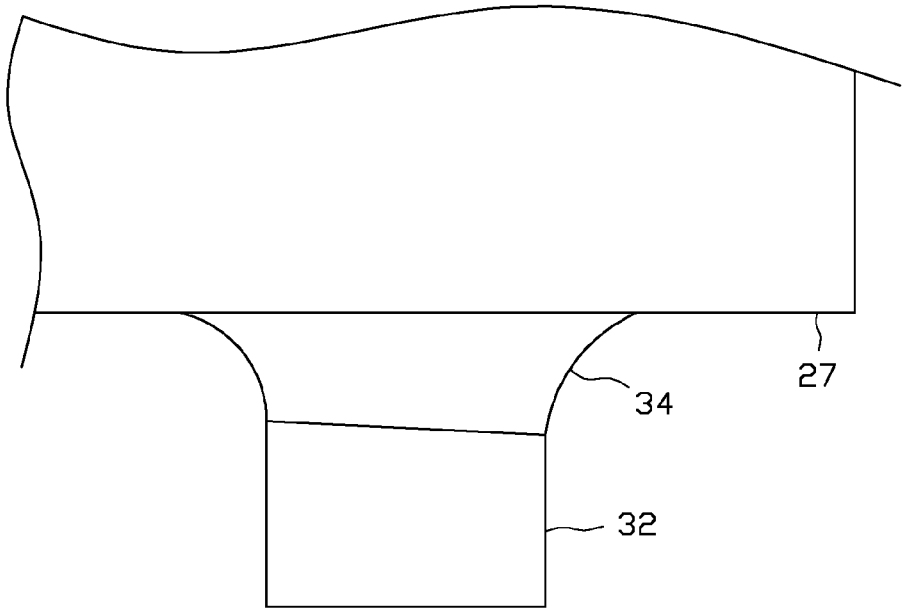
FIG. 11 is a partially-expanded front view of a molten bond between a ground electrode and a noble metal tip according to a second embodiment of the invention.
Figure 12:
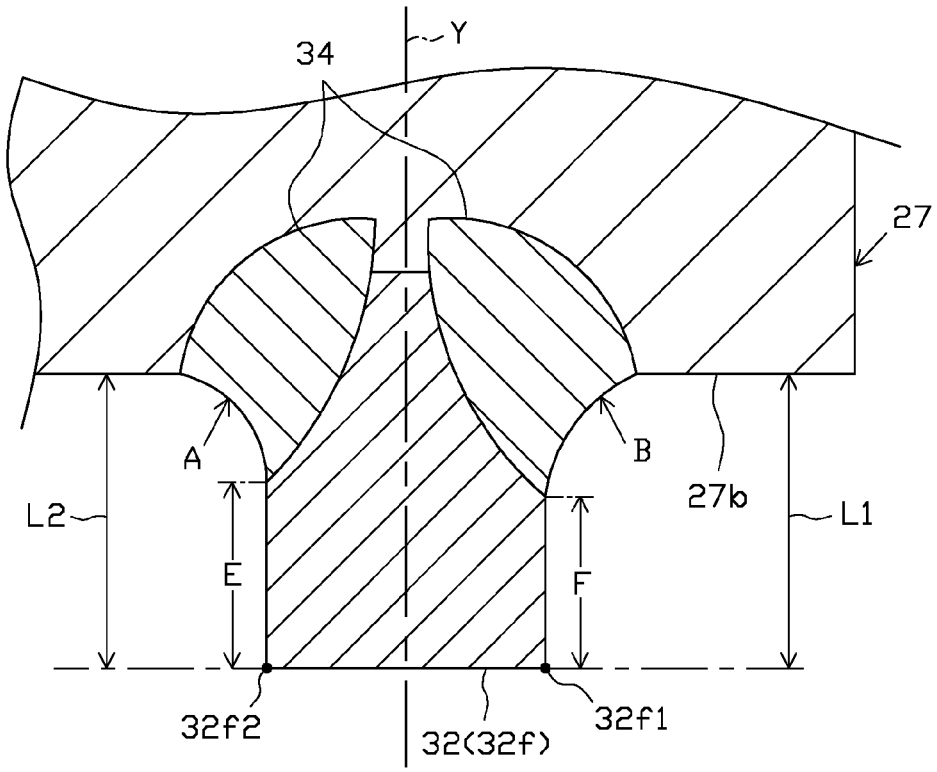
FIG. 12 is a partial cross-sectional view showing the positional relationship between a base-end-side molten bond and a front-end-side molten bond according to the second embodiment of the invention.

The construction of the molten bond 34 which is a characteristic feature of the second embodiment will be described. As shown in FIG. 11, an edge of the molten bond 34 which is positioned at the front end side of the noble metal tip 32 is formed so as to be adjacent to the front end of the noble metal tip 32 from a portion positioned at the base end side of the ground electrode 27 toward a portion positioned at the front end side of the ground electrode 27. That is, as shown in FIG. 12, the front-end-side molten bond B is formed so as to be closer to the front end of the noble metal tip 32, as compared with the base-end-side molten bond A. More specifically, when the shortest distance from the front end of the noble metal tip 32 to the base-end-side molten bond A on the center axis cross-section is set to E (mm) and the shortest distance from the front end of the noble metal tip 32 to the front-end-side molten bond B is set to F (mm), the molten bond 34 is formed so as to satisfy the following expression: $1.05 \leqq E/F \leqq 1.25$. In this embodiment, the molten bond 34 is formed so as to satisfy the following expression: $0.3\ mm \leqq E \leqq 0.05\ mm$.

As shown in FIG. 12, the noble metal tip 32 is bonded to the ground electrode 27 such that the front end surface 32*f* thereof is parallel to an end surface 27*b* of the ground electrode 27 at the center electrode 5. That is, a distance (front-end-side protruding length) L1 between a front-end-side end portion 32*f*1, which is positioned at the front end side of the ground electrode 27, on the front end surface 32*f* of the noble metal tip 32 and the end surface 27*b* along the center axis Y of the noble metal tip 32 is set to be equal to a distance (base-end-side protruding length) L2 between a base-end-side end portion 32*f*2, which is positioned at the base end side of the ground electrode 27, on the front end surface 32*f* of the noble metal tip 32 and the end surface 27*b* of the ground electrode 27 along the center axis Y of the noble metal tip 32.

Further, the noble metal tip 32 is bonded such that the front end surface 32*f* thereof protrudes as much as 0.8 mm from the end surface 27*b* of the ground electrode 27 along the center axis Y.

Figure 13:
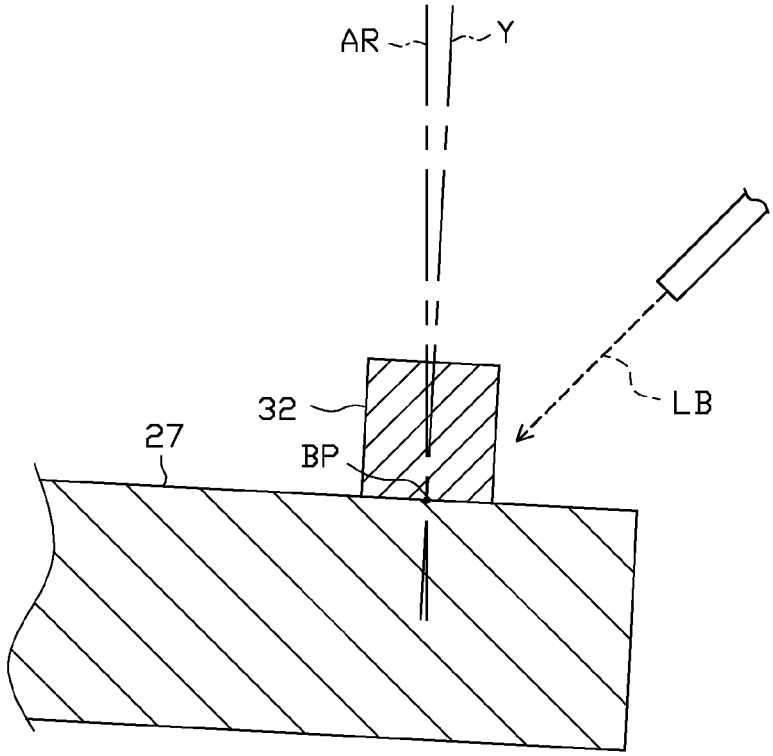
FIG. 13 is a cross-sectional schematic view illustrating a bonding method of the ground electrode and the noble metal tip according to the second embodiment of the invention.
Figure 14:
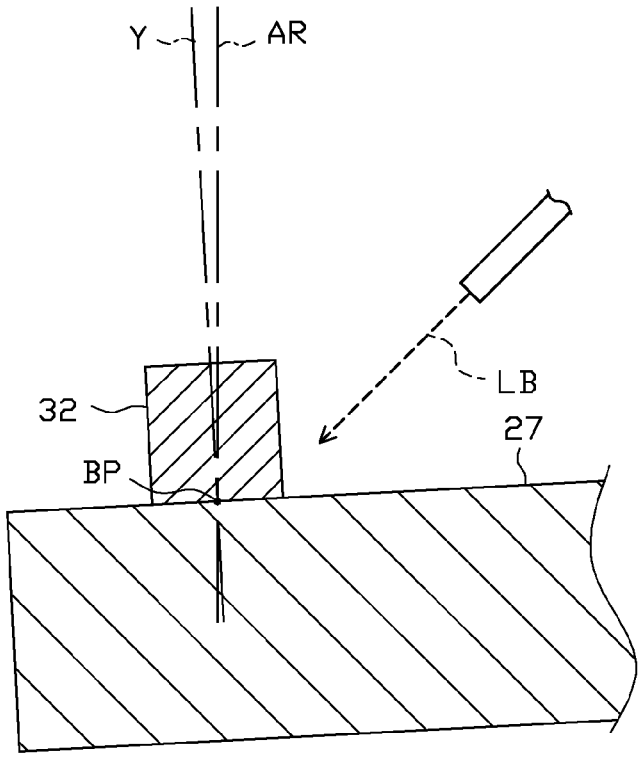
FIG. 14 is a cross-sectional schematic view illustrating the bonding method of the ground electrode and the noble metal tip according to the second embodiment of the invention.

Next, a bonding method of the metal electrode 27 and the noble metal tip 32 will be described. First, the base end of the noble metal tip 32 is provisionally locked to a predetermined portion of the ground electrode 27 by resistance welding in a state where the end portion is buried into the ground electrode 27. As shown in FIGS. 13 and 14, while the ground electrode 27 and the noble metal tip 32 are relatively rotated with an axis AR as the rotation axis, a laser beam LB of which the irradiation direction is fixed is intermittently irradiated onto the outer peripheral portion of the preliminarily bonded surface between the ground electrode 27 and the noble metal tip 32. In this case, the axis AR is formed by tilting the center axis Y of the noble metal tip 32 at a predetermined angle toward the base end side of the ground electrode 27 in a state where an intersection point BP between the center axis Y and a plane including one side surface of the ground electrode 27 is set as a base point. Accordingly, in the portion positioned at the front end side of the ground electrode 27, the laser beam LB is irradiated onto a position which is relatively closer to the front end of the noble metal tip 32. Meanwhile, in the portion positioned at the base end side of the ground electrode 27, the laser beam LB is irradiated onto a position which is relatively spaced from the front end of the noble metal tip 32. Therefore, the front-end-side molten bond B is formed so as to be closer to the front end of the noble metal tip 32, and the base-end-side molten bond A is formed so as to be relatively spaced from the front end of the noble metal tip 32.

As the above-described manufacturing method is used, the molten bond 34 can be formed such that the edge of the molten bond 34, which is positioned at the front end side of the noble metal tip 32, gradually approaches the leading end of the noble metal tip 32 from the portion positioned at the base end side of the ground electrode 27 toward the portion positioned at the front end side of the ground electrode 27, and without complicating the structure of the device and degrading production efficiency.

Figure 15:
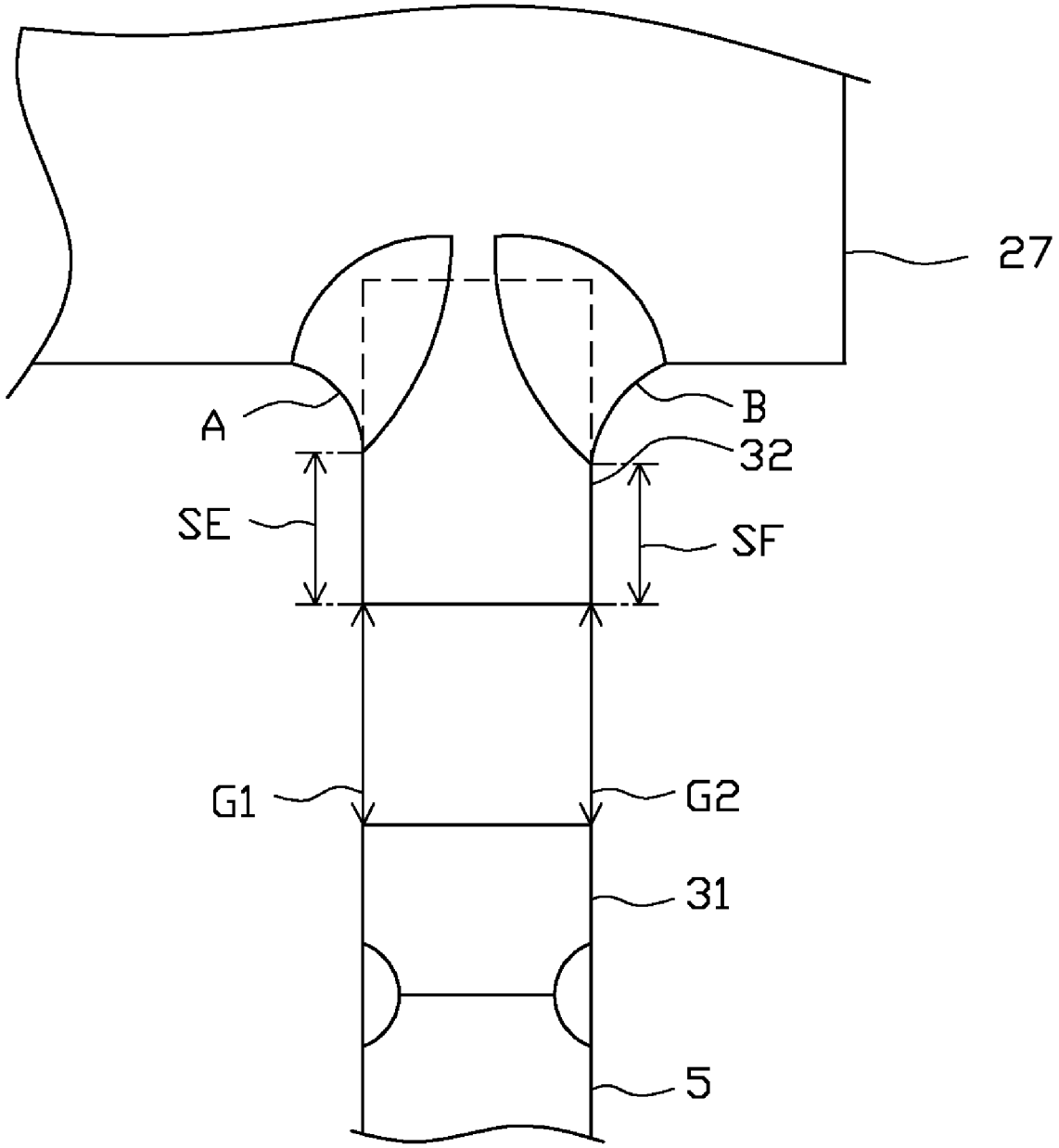
FIG. 15 is a cross-sectional view illustrating the concept of a sample used in the peeling resistance evaluation test.
Figure 16:
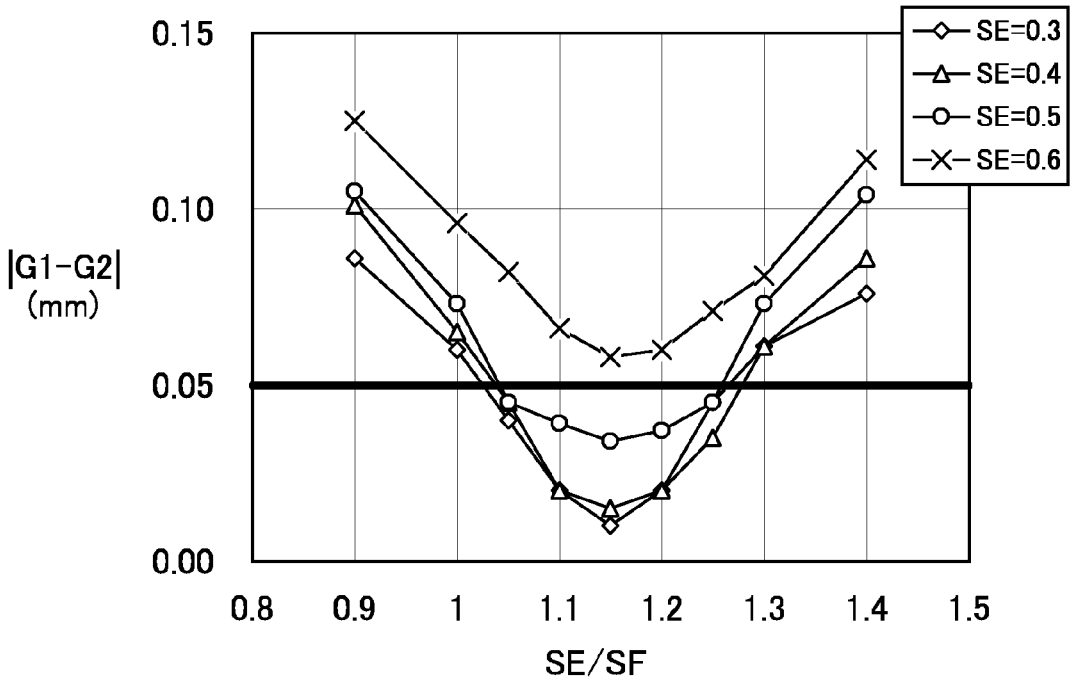
FIG. 16 is a graph showing the results of the peeling resistance evaluation test for samples in which SE and SE/SF are variously changed.

To confirm an operational effect exhibited by this embodiment, as shown in FIG. 15, a peeling resistance evaluation test was performed. To perform the peeling resistance evaluation test, a variety of spark plug samples were manufactured by changing a ratio (SE/SF) of the shortest distance SE between the front end of the noble metal tip and the base-end-side molten bond to the shortest distance SF between the front end of the noble metal tip at the ground electrode and the front-end-side molten bond. Then, the peeling resistance evaluation test was performed on the respective samples. The peeling resistance evaluation test is summarized as follows. That is, the respective samples were attached to a 2000 cc in-line six-cylinder engine, and the engine was driven in a full-load state (the number of engine rotations=5000 rpm) for 100 hours. After that, a distance G1 between portions of the noble metal tip at the center electrode and the noble metal tip at the ground electrode, which are positioned at the base end side of the ground electrode, and a distance G2 between portions of the noble metal tip at the center electrode and the noble metal tip at the ground electrode, which are positioned at the front end side of the ground electrode, were measured, and an absolute value |G1-G2| of a difference between the distances G1 and G2 was calculated. FIG. 16 is a graph showing the relationship between SE/SF and |G1-G2|. In FIG. 16, the test result when SE was set to 0.3 mm is plotted by outline rhomboids, the test result when SE was set to 0.4 mm is plotted by outline triangles, the test result when SE was set to 0.5 mm is plotted by outline circles, and the test result when DE was set to 0.6 mm is plotted by X marks. Further, the noble metal tip was formed of Pt-20Ir-5Rh alloy, and the ground electrode was formed of INCONEL 601 (trademark).

As shown in FIG. 16, in a sample in which SE was set in the range of 0.3 to 0.5 mm and SE/SF was set in the range of 1.05 to 1.25, it was found that |G1-G2| is equal to or less than 0.05 mm and uneven wear of the noble metal tip can be effectively suppressed. This is because, since the cross-sectional area of a portion of the noble metal tip at the ground electrode, which is positioned at the front end side of the ground electrode, is set to be smaller than that of a portion of the noble metal tip which is positioned at the base end side of the ground electrode, it is possible to reduce the amount of heat received by the portion positioned at the front end side of the ground electrode, which is easily heated. Accordingly, it is possible to reduce the temperature difference between the portion positioned at the front end side of the ground electrode and the portion positioned at the base end side of the ground electrode.

Meanwhile, in a sample in which SE/SF is less than 1.05 and SE/SF exceeds 1.25, it was found that |G1-G2| exceeds 0.05 mm and uneven wear occurs on the noble metal tip. This is caused for the following reason. That is, when SE/SF is set to less than 1.05, the amount of heat received by a portion of the noble metal tip, which is positioned at the front end side of the ground electrode, is not sufficiently reduced. Therefore, wear of that portion easily progresses. Meanwhile, when SE/SF exceeds 1.25, the amount of heat received by a portion of the noble metal tip, which is positioned at the front end side of the ground electrode, is extremely reduced. Therefore, wear of the portion positioned at the base end side of the ground electrode easily progresses.

In a sample in which SE is set to 0.6 mm, it was found that |G1-G2| becomes larger than 0.05 mm regardless of SE/SF and uneven wear of the noble metal tip occurs. This is because, since the noble metal tip at the ground electrode further protrudes from the ground electrode, the amount of heat received by the noble metal tip increases, and thus the balance in temperature difference between a portion of the noble metal tip positioned at the leading end side of the ground electrode and a portion of the noble metal tip positioned at the base end side of the ground electrode is lost.

Without being limited to the above-described embodiments, the present invention may also be embodied as follows. Further, the present invention may also be applied to application examples and modifications other than those described below.

Figure 10A:
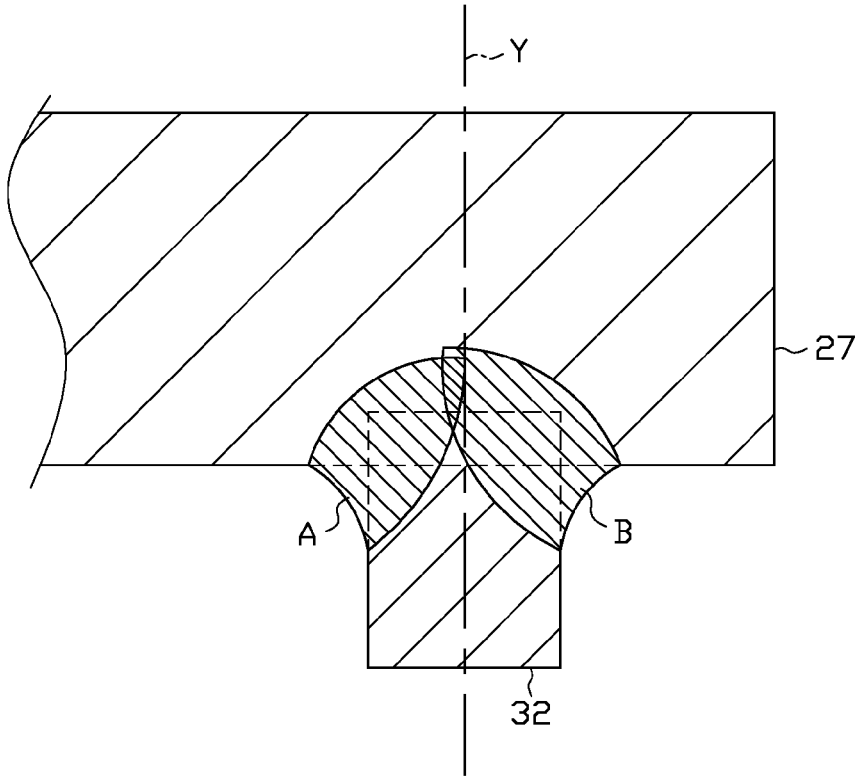
FIG. 10A is a partially-expanded cross-sectional view of a front-end-side molten bond and a base-end-side molten bond according to another embodiment of the invention.
Figure 10B:
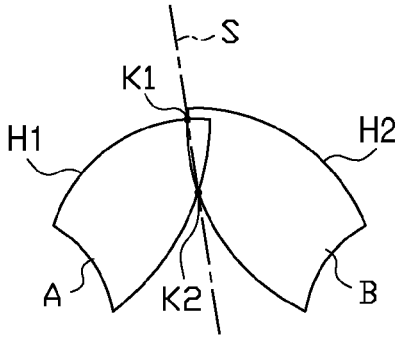
FIGS. 10B and 10C are schematic diagrams illustrating a method of determining the cross-sectional areas of the front-end-side molten bond and the base-end-side molten bond according to the embodiment of the invention.
Figure 10C:
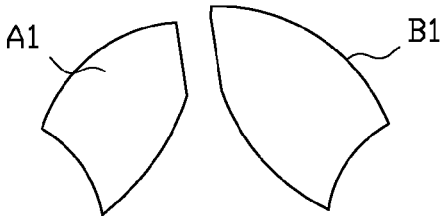

(a) In the above-described embodiment, the base-end-side molten bond A and the front-end-side molten bond B are formed so as not to cross the center axis Y of the noble metal tip 32. However, at least one of the base-end-side molten bond A and the front-end-side molten bond B may be formed so as to cross the center axis Y. This modification is shown in FIG. 10A, where the base-end-side molten bond A and the front-end-side molten bond B overlap each other. In this case, the cross-sectional area of the base-end-side molten bond A and the cross-sectional area of the front-end-side molten bond B are preferably determined as follows. That is, as shown in FIG. 10B, two intersection points K1 and K2 between an outline H1 forming the outer shape of the base-end-side molten bond A and an outline H2 forming the outer shape of the front-end-side molten bond B on the center axis cross-section are connected through a hypothetical straight line S. Further, as shown in FIG. 10C, the molten portion A1 (the molten portion A not including the molten portion at the front end side of line S) is taken as "the base-end-side molten bond A", and the molten portion B1 (the molten portion B not including the molten portion at the base end side of line S) is taken as "the front-end-side molten bond B".

(b) In the above-described embodiment, the cross-sectional area of the ground-electrode-side molten bond D1 in the base-end-side molten bond A is set to be 1.0 to 2.0 times larger than that of the noble-metal-tip-side molten bond C1, and the cross-sectional area of the ground-electrode-side molten bond D2 in the front-end-side molten bond B is set to be 1.0 to 2.0 times larger than that of the noble-metal-tip-side molten bond C2. On the contrary, the cross-sectional area of the ground-electrode-side molten bond D1 (D2) in any one of the base-end-side molten bond A and the front-end-side molten bond B may be set to be 1.0 to 2.0 times larger than that of the noble-metal-tip-side molten bond C1(C2).

(c) In the above-described embodiment, an electrode having a relatively small front-end-side cross-sectional area is (for example, more than 2.0 $mm^2$ and less than 3.5 $mm^2$) may be used as the ground electrode 27, in order to satisfy recent demand for a reduction in size of the spark plug. As such, when the cross-sectional area is relatively small, the heat dissipation property of the ground electrode 27 is degraded. Therefore, the ground electrode 27 may be easily heated, and thus the balance of heat stress applied to the noble metal tip 32 may be easily lost. In this case, when the above-described construction is adopted, the balance of heat stress can be effectively maintained. That is, under conditions where the ground electrode 27 is easily heated, the operational effect of the above-described embodiment becomes more apparent.

(d) In the above-described embodiment, the noble metal tip 32 is formed of Pt-20Ir-5Rh alloy. However, the noble metal tip 32 may be formed of another noble metal or noble metal alloy. For example, the noble metal tip 32 may be formed of a Pt-20Rh alloy.

Figure 17:
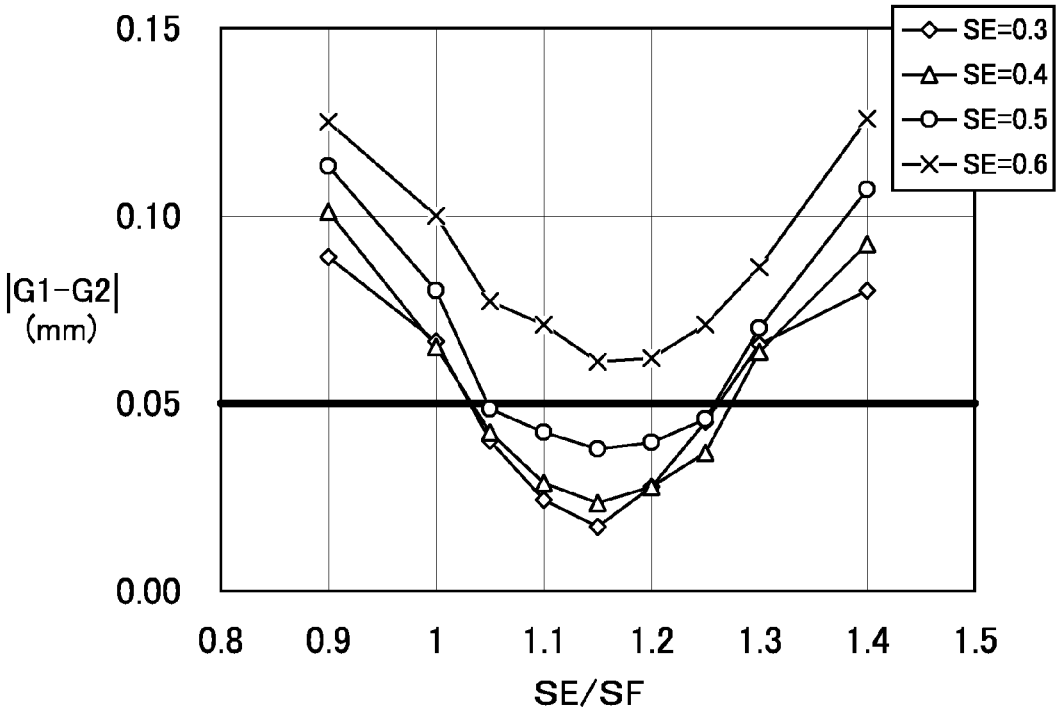
FIG. 17 is a graph showing the results of the peeling resistance evaluation test for samples in which SE and SE/SF are variously changed, in different noble metal tips

However, as the composition of the noble metal tip 32 is changed, the thermal conductivity of the molten bond 34 may change. Therefore, in order to investigate whether or not the operational effect of the above-described embodiment is obtained when the composition of the noble metal tip 32 is changed, a noble metal tip formed of Pt-20Rh was provided. Further, a variety of samples were manufactured by variously changing the ratio (SE/SF) of the shortest distance SF between the front end of the noble metal tip at the ground electrode and the front-end-side molten bond to the shortest distance SE between the front end of the noble metal tip and the base-end-side molten bond. Further, the above-described peeling resistance evaluation test was performed on the respective samples. FIG. 17 shows the results of the evaluation test. Further, the thermal conductivity of Pt-20Rh alloy is about 0.372 W/cm·K, and the ground electrode was formed of INCONEL 601 (trademark).

As shown in FIG. 17, for a noble metal tip formed of a Pt-20Rh alloy, in a sample in which SE was set in the range of 0.3 to 0.5 mm and SE/SF was set in the range of 1.05 to 1.25, |G1-G2| was less than 0.05 mm, and uneven wear of the noble metal tip could be effectively suppressed, as in the above-describe embodiment. That is, when noble metal tip is formed of a noble metal material having larger thermal conductivity than that of a metal material forming the ground electrode, the operational effect of the above-described embodiment is realized. Accordingly, as long as such a relationship is satisfied, the same operational effect is exhibited even in a noble metal tip formed of Ir-based alloy, without being limited to a Pt-based alloy.

(e) In the above-described embodiment, the ground electrode 27 is formed of INCONEL 601 (trademark). However, the metal material composing the ground electrode 27 is not limited to INCONEL 601. Further, to effectively suppress uneven wear of the noble metal tip 32, the ground electrode 27 is preferably formed of a metal material having smaller thermal conductivity than that of the noble metal material constituting the noble metal tip 32. For example, the ground electrode 27 may be formed of Ni-15.5Cr-8Fe alloy [INCONEL 600 (trademark)] which is a metal material having relatively small thermal conductivity of about 0.149 W/cm·K.

(f) In the above-described embodiment, the noble metal tip 32 is bonded to the ground electrode 27 such that the end surface 27*b* of the ground electrode 27 and the front end surface 32*f* of the noble metal tip 32 are parallel to each other, and the front-end-side protruding length L1 and the base-end-side protruding length L2 are equalized. However, the noble metal tip 32 may be bonded to the ground electrode 27 such that the end surface 27*b* and the front end surface 32*f* are substantially parallel to each other. Accordingly, the noble metal tip 32 may be bonded to the ground electrode 27 such that a difference between the front-end-side protruding length L1 and the base-end-side protruding length L2 falls within a predetermined range (for example, 0.05 mm).

(g) In the above-described embodiment, the ground electrode 27 is bonded to the front end portion 26 of the metal shell 3. However, the ground electrode may be formed by machining a portion of the metal shell (or a portion of a front end metal shell which is previously welded to the metal shell) (as disclosed, for example, in Japanese Unexamined Patent Application Publication No. 2006-236906).

(h) In the above-described embodiment, the tool engagement portion 19 is formed to have a hexagonal cross section. However, the shape of the tool engagement portion 19 is not limited thereto. For example, the tool engagement portion 19 may be formed in a Bi-HEX shape (a modified dodecagon) [ISO 22977:2005(E)].

It should further be apparent to those skilled in the art that various changes in form and detail of the invention as shown and described above may be made. It is intended that such changes be included within the spirit and scope of the claims appended hereto.

This application is based on Japanese Patent Application JP 2007-200283, filed Aug. 1, 2007, and Japanese Patent Application JP 2008-161565, filed Jun. 20, 2008, the entire contents of which are hereby incorporated by reference, the same as if set forth at length.

What is claimed is:

1. A spark plug for an internal combustion engine, comprising:

a cylindrical insulating body having an axial hole extending in an axial direction thereof;

a center electrode having a front end surface provided in the axial hole;

a cylindrical metal shell provided on an outer circumference of the insulating body; and a ground electrode having a base end provided on a front end portion of the metal shell and a noble metal tip comprising a noble metal having a base end that is bonded to a front end side surface of the ground electrode such that a front end surface of the noble metal tip is opposed to the front end surface of the center electrode, wherein the noble metal tip is bonded to the ground electrode such that a molten bond in which part of the noble metal tip and part of the ground electrode are molten together is formed at an interface between the noble metal tip and the ground electrode, and when viewed in cross-section including a center axis of the noble metal tip along a longitudinal direction of the ground electrode, a sum of a cross-sectional area of a base-end-side molten bond (A) positioned at a base end side of the ground electrode and a cross-sectional area of a front-end-side molten bond (B) positioned at a front end side of the ground electrode is equal to or greater than 4 $mm^2$, and the cross-sectional area of the front-end-side molten bond (B) is 1.1 to 1.3 times greater than that of the base-end-side molten bond (A).

2. The spark plug according to claim 1, wherein the noble metal tip has a base end buried in the ground electrode, each of the base-end-side molten bond (A) and the front-end-side molten bond (B) is divided into a noble-metal-tip-side molten bond (C) that is within a noble metal tip side region partitioned by a first rectangular hypothetical outline of the noble metal tip before the molten bond is formed, and a ground-electrode-side molten bond (D) that is within a region partitioned by a second hypothetical outline of the ground electrode before the molten bond is formed and outside the region partitioned by the first rectangular hypothetical outline, and in at least one of the base-end-side molten bond (A) and the front-end-side molten bond (B), a cross-sectional area of the ground-electrode-side molten bond (D) is 1.0 to 2.0 times larger than that of the noble-metal-tip-side molten bond (C) in a cross-section including the center axis of the noble metal tip along the longitudinal direction of the ground electrode.

3. The spark plug according to claim 1, wherein when a shortest distance from the front end of the noble metal tip to the base-end-side molten bond (A) is E (mm) and a shortest distance from the front end of the noble metal tip to the front-end-side molten bond (B) is F (mm) on a cross-section including the center axis of the noble metal tip along the longitudinal direction of the ground electrode, the following expressions (1) and (2) are satisfied:

$$1.05 \leqq E/F \leqq 1.25 \quad (1)$$

$$0.3\ \text{mm} \leqq E \leqq 0.5\ \text{mm} \quad (2).$$

* * * * *